US011638448B2

(12) United States Patent
Farrell

(10) Patent No.: US 11,638,448 B2
(45) Date of Patent: May 2, 2023

(54) GARMENT FOR LOOP ATTACHMENT THROUGH LEG OPENINGS OF BIKINI BOTTOM TO COVER MIDRIFF

(71) Applicant: Candice Farrell, Wantagh, NY (US)

(72) Inventor: Candice Farrell, Wantagh, NY (US)

( * ) Notice: Subject to any disclaimer, the term of this patent is extended or adjusted under 35 U.S.C. 154(b) by 515 days.

(21) Appl. No.: 16/179,281

(22) Filed: Nov. 2, 2018

(65) Prior Publication Data

US 2019/0069617 A1 Mar. 7, 2019

Related U.S. Application Data

(63) Continuation-in-part of application No. 15/087,229, filed on Mar. 31, 2016, now abandoned.

(51) Int. Cl.

| | |
|---|---|
| ***A41D 15/00*** | (2006.01) |
| ***A41D 7/00*** | (2006.01) |
| ***A41D 1/22*** | (2018.01) |

(52) U.S. Cl.

CPC ..... *A41D 15/002* (2013.01); *A41D 1/22* (2013.01); *A41D 7/00* (2013.01); *A41D 7/005* (2013.01); *A41D 2400/70* (2013.01)

(58) Field of Classification Search

CPC ..... A41D 15/002; A41D 15/00; A41D 7/005; A41D 7/00; A41D 1/22; A41D 2400/70

See application file for complete search history.

(56) References Cited

U.S. PATENT DOCUMENTS

| | | | | | |
|---|---|---|---|---|---|
| 1,364,693 | A | * | 1/1921 | Bonheur | A41D 15/00 2/91 |
| 1,999,010 | A | * | 4/1935 | Tait | A41D 7/00 450/30 |
| 2,521,020 | A | * | 9/1950 | Prescott | A41D 15/00 2/70 |
| 3,160,892 | A | * | 12/1964 | Semons | A41D 7/008 2/88 |
| 4,215,435 | A | * | 8/1980 | Miele | A41D 15/002 2/227 |
| 4,573,218 | A | * | 3/1986 | Saggs | A41D 15/002 2/108 |
| 4,656,669 | A | * | 4/1987 | Beard | A41D 7/00 2/67 |
| 4,815,145 | A | * | 3/1989 | Chow | A41D 7/00 2/67 |
| RE33,406 | E | | 10/1990 | Wior | |
| 5,050,244 | A | * | 9/1991 | Kleinman | A41D 1/067 2/227 |
| 5,083,316 | A | * | 1/1992 | Kuehner | A41D 7/00 2/67 |
| 5,628,064 | A | * | 5/1997 | Chung | A41D 15/00 2/119 |
| 6,138,282 | A | | 10/2000 | Follese | |

(Continued)

*Primary Examiner* — Bao-Thieu L Nguyen

(74) *Attorney, Agent, or Firm* — Carter, DeLuca & Farrell LLP; Christopher G. Trainor

(57) ABSTRACT

A garment that is configured to attach to a bikini bottom is provided. The garment includes a band that is configured to be worn by a user. The band has a generally uniform circumference and includes a top portion, a bottom portion, and at least one attachment device that is configured to releasably attach the bottom portion to the top portion for securing the band to the bikini bottom when the bottom portion is received through at least one leg opening of the bikini bottom.

4 Claims, 3 Drawing Sheets

(56) References Cited

U.S. PATENT DOCUMENTS

| | | | | |
|---|---|---|---|---|
| 6,185,741 | B1 * | 2/2001 | Kehoe | A41D 7/00 2/67 |
| 6,240,560 | B1 * | 6/2001 | DeCaro | A41B 9/002 2/67 |
| 8,272,072 | B1 * | 9/2012 | Fowler | A41D 15/00 2/263 |
| 9,015,865 | B2 * | 4/2015 | Siragusa | A41B 3/04 2/116 |
| 9,364,035 | B1 * | 6/2016 | Shachaf | A41D 15/00 |
| 9,717,283 | B1 * | 8/2017 | McCalla | A41C 1/08 |
| 2007/0266472 | A1 * | 11/2007 | DuFaux | A41D 15/002 2/80 |
| 2010/0058508 | A1 * | 3/2010 | Hersh | A41D 7/00 2/67 |
| 2010/0199399 | A1 * | 8/2010 | Garza | A41D 15/002 2/24 |
| 2011/0061147 | A1 * | 3/2011 | Welfeld | A41C 1/08 2/237 |
| 2011/0225700 | A1 * | 9/2011 | Kogut | A41C 3/0035 2/113 |
| 2013/0019370 | A1 * | 1/2013 | Dweck | A41D 7/00 2/67 |
| 2015/0173427 | A1 * | 6/2015 | Sawyer | A41D 7/00 2/67 |
| 2016/0073718 | A1 * | 3/2016 | McKinlay | A41D 31/00 450/95 |
| 2016/0116153 | A1 * | 4/2016 | Suarez | A41D 1/002 362/108 |
| 2018/0177243 | A1 * | 6/2018 | Hawkins | A41B 9/08 |
| 2018/0255853 | A1 * | 9/2018 | Spathas | A41D 27/20 |
| 2018/0279699 | A1 * | 10/2018 | Olmos Plaza | A41D 1/14 |

* cited by examiner

GARMENT FOR LOOP ATTACHMENT THROUGH LEG OPENINGS OF BIKINI BOTTOM TO COVER MIDRIFF

PRIORITY

The application is a continuation in part of application Ser. No. 15/087,229, which was filed with the U.S. Patent and Trademark Office on Mar. 31, 2016, the disclosure of which is incorporated herein by reference.

BACKGROUND

1. Field

The present disclosure relates to a garment, and more particularly, to a garment that is configured to attach to a bikini bottom to cover the midriff of a wearer thereof.

2. Description of the Related Art

Swimsuits typically come in two types, a one-piece type or a two-piece type, which is commonly referred to as a bikini. One one-piece bathing suits cover the pelvic area and a majority of the torso, while the bikini separately covers the pelvic area and upper torso, leaving the midriff bare.

While both types of swimsuits are suitable for their intended use, women who would otherwise opt to wear a bikini will sometimes opt for the one-piece bathing suit. For example, women who have scarring near their lower abdomen, e.g., as a result of a surgical procedure or being pregnant, may opt for the one-piece bathing suit as opposed to the bikini to hide their scaring.

U.S. Pat. No. 9,364,035 to Shachaf discloses a clothing trim that can be removeably connected to a bottom edge of a clothing item via a fastening strip. Shachaf further discloses an extension trim that can be affixed to a bottom side of a clothing item, e.g., a skirt, shirt, or dress. However, Shachaf does not relate to swimwear. Moreover, the clothing and extension trims of Shachaf are merely attachable by a fastening strip, e.g., snaps, zippers, or buttons, and are not attachable through a leg opening of a bikini bottom.

U.S. Pat. No. 4,656,669 to Beard discloses a two-piece bathing suit with a hidden pocket in a panty section, with the pocket containing additional bathing suit materials to create an ensemble effect. However, like Shachaf, Beard is merely attachable by fastening strip, not through the leg opening of the bikini bottom.

SUMMARY

Embodiments of the present disclosure are described in detail with reference to the drawing figures wherein like reference numerals identify similar or identical elements.

In accordance with an aspect of the present disclosure, there is provided a garment that is configured to attach to a bikini bottom worn by a user, with the garment including a cylindrical band configured to be worn by the user, with the cylindrical band including a top portion, a bottom portion, and a pair of attachment devices that releasably attach the bottom portion to the top portion. The pair of attachment devices secure the cylindrical band to the bikini bottom by passing respective parts of the bottom portion through respective leg openings of the bikini bottom and releasably securing the respective parts of the bottom portion to opposite sides of the top portion.

In accordance with an aspect of the present disclosure, there is provided a method of extending coverage of a bikini bottom over a midriff by extending respective parts of a bottom portion of a garment downward through respective leg openings of the bikini bottom; folding a top portion of the garment downward onto the extended respective parts of the bottom portion; encircling the respective leg openings by attaching the respective parts of the bottom portion of the garment to corresponding parts of the top portion of the garment via a pair of attachment that devices each have two parts, with each attachment device of the pair of attachment devices being positioned on a front of the garment, on opposite sides of a user's naval, in a wearing state.

BRIEF DESCRIPTION OF THE DRAWING

Various embodiments of the present disclosure are described hereinbelow with references to the drawings, wherein.

DETAILED DESCRIPTION

Detailed embodiments of the present disclosure are disclosed herein; however, the disclosed embodiments are merely examples of the disclosure, which may be embodied in various forms. Therefore, specific structural and functional details disclosed herein are not to be interpreted as limiting, but merely as a basis for the claims and as a representative basis for teaching one skilled in the art to variously employ the present disclosure in virtually any appropriately detailed structure.

As noted above, a garment that is configured to attach to a bikini bottom may prove useful in the bathing suit industry, other than the shapeware industry, with such a garment being described herein.

Figure 1:
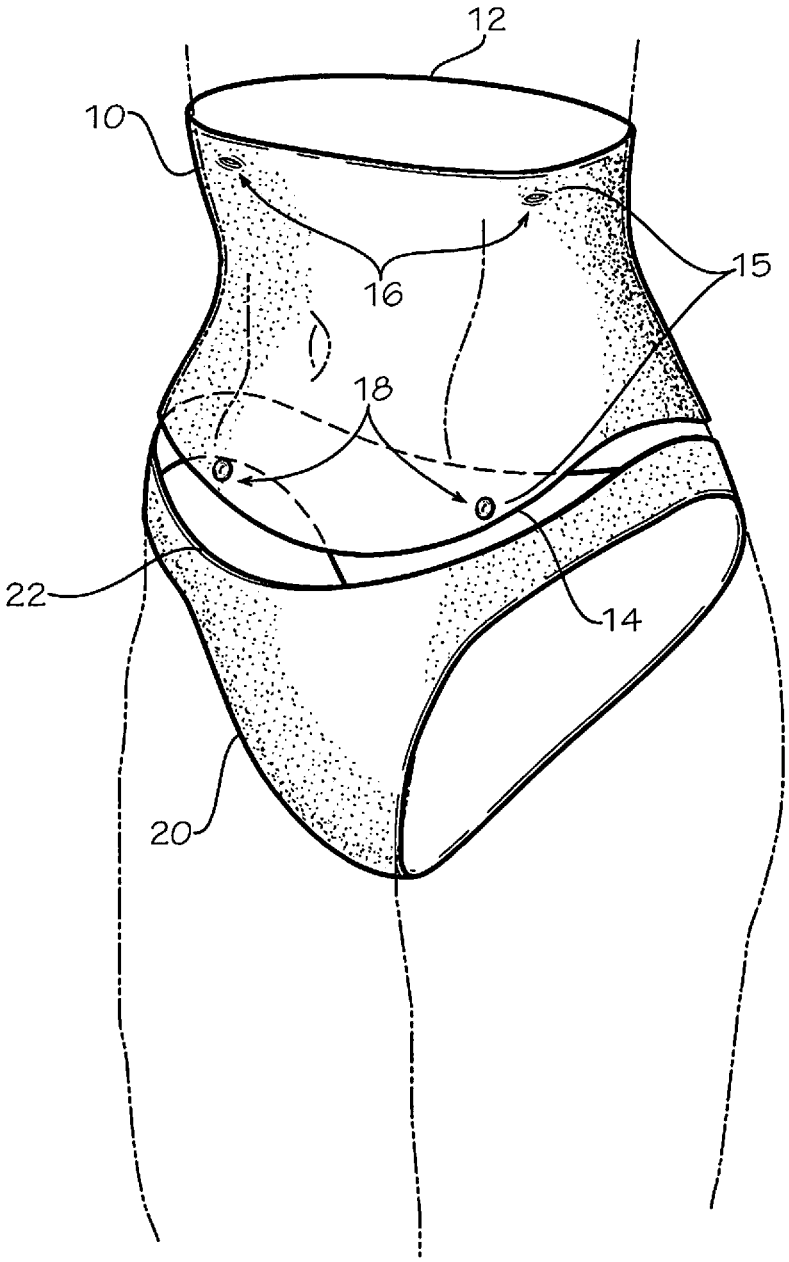
FIG. 1 illustrates a garment that is configured to be worn by a user to attach to a bikini bottom, with the garment shown unattached to the bikini bottom, according to an embodiment of the present disclosure.

FIG. 1 illustrates a garment 10 being worn by a user (e.g. a woman) before being removeably attached to a bikini bottom 20, i.e., with the garment 10 being shown unattached to the bikini bottom 20, particularly a low waist bikini.

Figure 3:
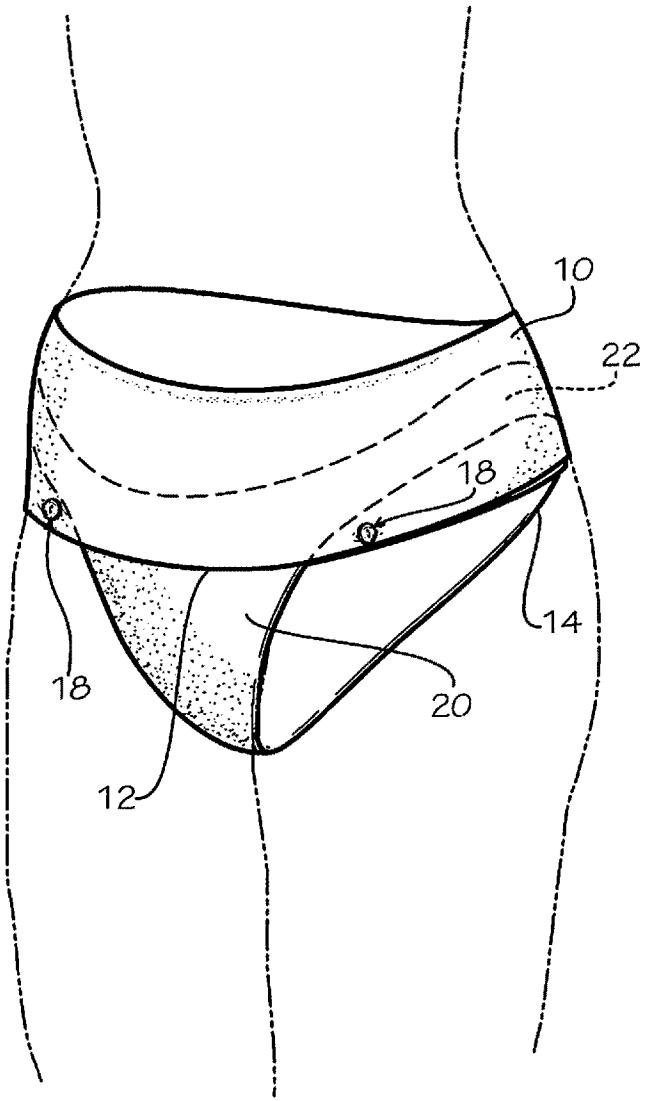
FIG. 3 illustrates the garment of FIG. 1 attached to the bikini bottom.

The garment 10, i.e., midriff cover, is formed as a band having a generally cylindrical configuration, i.e., a cylindrical band configuration, with a top portion 12, a bottom portion 14, and a pair of attachment devices that releasably attach the bottom portion 14 to respective parts of the top portion 12, to secure the garment 10 to the bikini bottom 20 when each attachment device of the bottom portion 14 is received through respective leg openings of the bikini bottom 20 (FIGS. 2 and 3) and attached to respective parts of the top portion 14.

The pair of attachment devices includes apertures 16 that are located on respective sides of the top portion 12 of the garment 10. A pair of buttons 18 are located at corresponding positions on the bottom portion 14 of the garment and configured to be received through the pair of apertures 16 when a user secures the garment 10 to the bikini bottom 20 by threading through the respective leg openings.

While the pair of buttons 18 and the pair of apertures 16 are shown provided on the bottom portion 14 and top portion 12, respectively, the pair of buttons 18 can alternatively be provided on top portion 12 and the pair of apertures 16 can be provided on the bottom portion 14.

The garment 10 can be made from any suitable material including, but not limited to, nylon, cotton, polyester, spandex, synthetic fiber having enhanced elasticity such as Lycra®, lace, elastane, blended synthetic fibers, polybutylene terephthalate, stretch fabric, other suitable material, or combination thereof.

Figure 2:
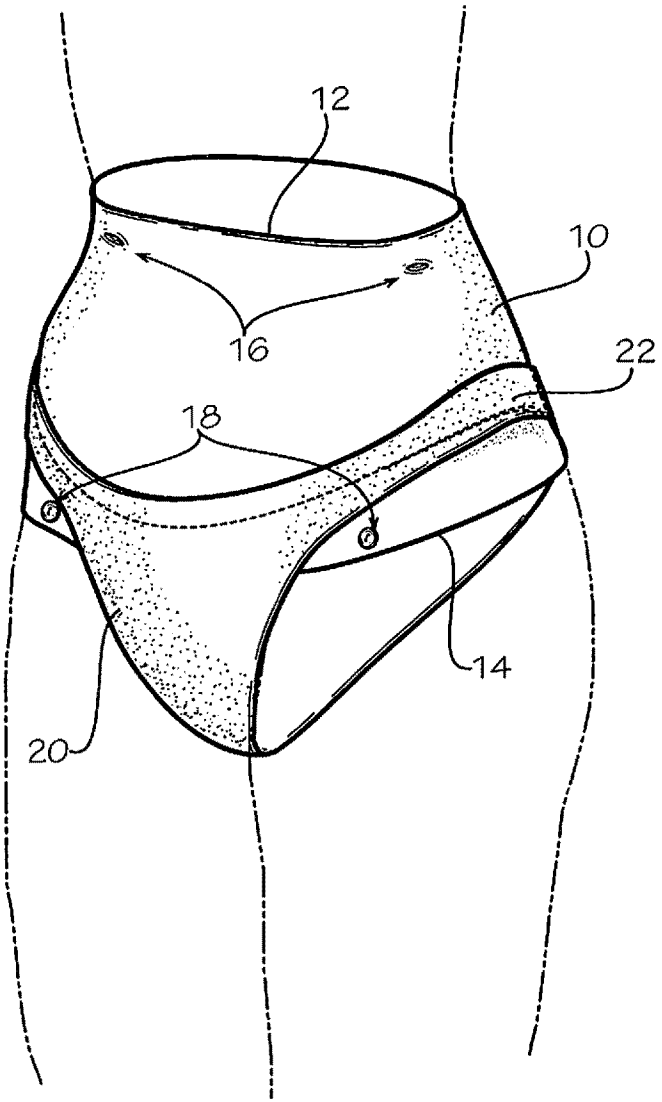
FIG. 2 illustrates the garment of FIG. 1, with a bottom portion of the garment being received through a leg opening of the bikini bottom.

In use, a user can slip the garment 10 around the user's midriff, as shown in FIG. 1. With the user wearing the bikini bottom 20, the user pulls each side of the two sides of the bottom portion 14 of the garment 10 through a respective leg opening of the bikini bottom 20 (FIG. 2).

To secure the garment 10 to the bikini bottom 20, the user folds the top portion 12 of the garment 10 over a waist portion 22 of the bikini bottom 20, towards the bottom portion 14 of the garment 10, and secure the top portion 12 to the bottom portion 14 by affixing each button 18 to a respective aperture 16.

Coverage of a bikini bottom is extended over a midriff by extending respective parts of a bottom portion of a garment downward through respective leg openings of the bikini bottom; folding a top portion of the garment downward onto the extended respective parts of the bottom portion; encircling the respective leg openings by attaching the respective parts of the bottom portion of the garment to corresponding parts of the top portion of the garment via a pair of attachment that devices each have two parts, with each attachment device of the pair of attachment devices being positioned on a front of the garment, on opposite sides of a user's naval, in a wearing state.

From the foregoing and with reference to the various figure drawings, those skilled in the art will appreciate that certain modifications can also be made to the present disclosure without departing from the scope of the same. For example, other devices can be used for the attachment device 15. More particularly, the buttons can be replaced with a string, to allow to fastening through being bikini bottoms that have a thicker waistband.

Moreover, the garment 10 can come in a variety of sizes and colors to accommodate a need of a user or a manufacturer. For example, a size of the garment 10 can correspond to a size of the user's midriff, to provide a vertical extension of the bikini bottom.

Figure 4:
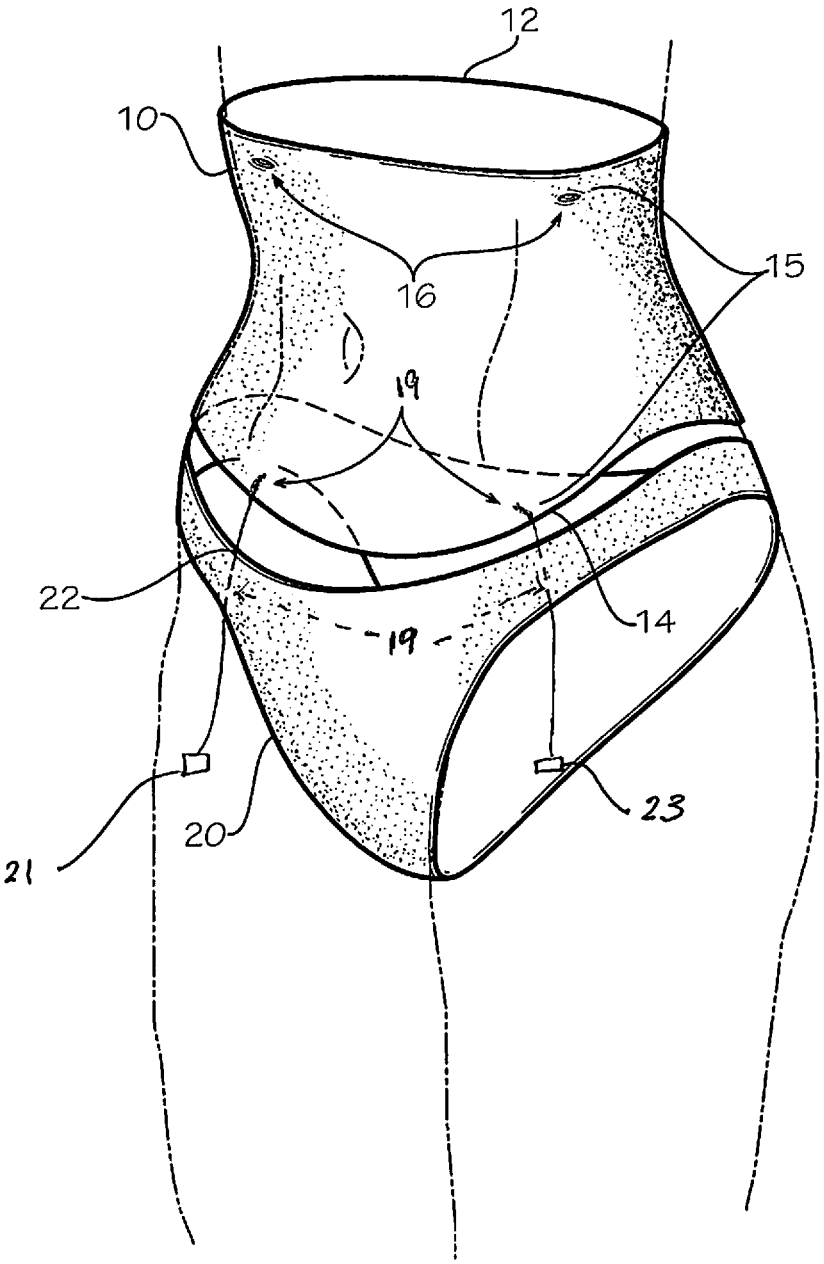
FIG. 4 illustrates a garment according to another embodiment of the present disclosure.

In certain instances, it may prove advantageous to provide the garment 10 with a top portion 12 that is configured to indirectly connect to the bottom portion 14. For example, as noted above, the attachment mechanism may include string, useful for high-waist bikinis. In this particular instance, a string 19 can be used to tie or wrap around the waist portion 22 of the bikini bottom 20 to attach the garment 10 to the bikini bottom 20. For example, to attach the garment 10 to the bikini bottom 20, the user can secure the bottom portion 14, which includes the string 19 to extend the operable length of the buttons 18, of the garment 10 to the waistline 22 of the bikini bottom 20 (see FIG. 4, for example); the string 19 can be looped through the leg opening of the bikini bottom 20. After looping through the leg opening, an aglet 21 of the string can be affixed to apertures 16 to secure the garment 10 to the bikini bottom 20.

A charm, pendant, or the like can be used to enhance the ornamentality of the aglet 21.

While the garment 10 has been described herein as being used by women, men are also contemplated users, as the garment 10 can be configured to attach to a men's bathing suit, to provide a waste sash, e.g., cummerbund.

While several embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed:

1. A swimsuit comprising:

a bikini bottom having a waistband and leg openings; and a garment including a band configured to be worn around a waist, the band including:

a top portion having first attachment devices, and a bottom portion spaced from the top portion having second attachment devices, wherein the first attachment devices are adapted to engage the second attachment devices to secure the band in a folded banded configuration through leg openings of the bikini bottom, wherein the garment is secured about the waistband of the bikini bottom through the leg openings of the bikini bottom by the first and second attachment devices.

2. The swimsuit of claim 1, the first attachment devices are buttons.

3. The swimsuit of claim 1, wherein the band is made from a material that is selected from a group consisting of nylon, cotton, polyester, spandex, and synthetic fiber.

4. The swimsuit of claim 1, wherein the garment is separable from the bikini bottom by uncoupling the first and second attachment devices.

* * * * *